United States Patent [19]

Brock

[11] 4,393,902

[45] Jul. 19, 1983

[54] TRANSMISSION FOR THE SHED-FORMING MECHANISM OF A LOOM

[75] Inventor: Josef Brock, Viersen, Fed. Rep. of Germany

[73] Assignee: Maschinenfabrik Carl Zangs Aktiengesellschaft, Krefeld, Fed. Rep. of Germany

[21] Appl. No.: 186,032

[22] Filed: Sep. 11, 1980

[30] Foreign Application Priority Data

Sep. 19, 1979 [DE] Fed. Rep. of Germany ..... 2937760

[51] Int. Cl.[3] ..... D03C 1/00; F16H 1/28; F16H 35/02

[52] U.S. Cl. ..... 139/76; 74/394; 74/802

[58] Field of Search ..... 74/393, 394, 802; 139/76

[56] References Cited

U.S. PATENT DOCUMENTS 2,915,911 12/1959 Hebeler et al. ..... 74/393

FOREIGN PATENT DOCUMENTS 699477 10/1940 Fed. Rep. of Germany ..... 74/393
2062980 5/1972 Fed. Rep. of Germany .
1101585 4/1955 France ..... 74/394
911772 11/1962 United Kingdom ..... 74/393

*Primary Examiner*—Allan D. Herrmann
*Attorney, Agent, or Firm*—Martin A. Farber

[57] ABSTRACT

A transmission for the shedding mechanism (dobby) of a loom in order to produce a non-uniform drive from a uniform drive, having a drive shaft and a driven shaft aligned therewith, said shafts being mounted in a transmission housing. In order to simplify the construction, a rotor is arranged fixed for rotation on the drive shaft, the rotor bearing at least one gear segment which is swingably supported on an eccentric shaft and has two cam rollers arranged in different planes, the gear segment being in engagement with a driven pinion arranged fixed for rotation on the driven shaft and the cam rollers cooperating in force-actuated and/or form-locked manner with two cams fastened in different planes to the transmission housing, the asymmetry of which cams producing a relative movement per revolution between the drive shaft and the driven shaft. The relative movement per revolution can be adjusted by replacing the two cams. The rotor can also be formed with two arms and carry two gear segments, the cam rollers of which cooperate with the two cams.

10 Claims, 5 Drawing Figures

TRANSMISSION FOR THE SHED-FORMING MECHANISM OF A LOOM

The present invention relates to a transmission for the shed-forming (shedding) mechanism (dobby) of a loom for the production of a non-uniform drive from a uniform drive, having a drive shaft and a driven shaft aligned therewith, the shafts being supported in a transmission housing.

From West German OS No. 2 062 980 there is known a drive transmission from a loom to a shed-forming machine which effects, at least once per revolution, a change in the angular speed transmitted. For this purpose, the drive transmission has a planetary gearing in which the planet gear wheel which travels on the stationary sun gear wheel is supported eccentrically on the drive shaft and is provided on its axis with a pin which is also arranged eccentrically and which engages into an approximately radially extending groove of the driven shaft. By a change in the eccentricity of the pin which is arranged in the radially extending groove, the angular velocity can be adjusted. This known drive transmission, possesses, in the interengaging planet and sun wheels as well as in the slot guide for the eccentrically supported pin a plurality of interengaging parts which are subject to wear and the play of which after a lengthy period of operation produces strong operating noises as a result of the acceleration and deceleration of the machine parts which are coupled to each other.

Proceeding herefrom, the object of the present invention is to create a transmission for the shedding mechanism of a loom which is of simple construction and has only a few parts subject to wear so that the play can be kept as small as possible.

As a technical solution there is proposed a transmission of the type described above in which a rotor is arranged fixed for rotation on the drive shaft, the rotor has at least one gear segment supported swingably on an eccentric shaft, each gear segment having two cam rollers arranged in different planes, the gear segment is in engagement with a drive pinion arranged fixed for rotation on the driven shaft and the cam rollers cooperate in force-actuated and/or form-locked (held in engagement by the closed complementary shape of the respective parts) manner with two cams fastened in different planes to the transmission housing, the asymmetry of which cams produces a relative movement per revolution between the drive shaft and the driven shaft. The relative movement per revolution can be adjusted by replacing the two cams.

In one practical embodiment of a transmission developed in accordance with the invention, the rotor can be developed with two arms and bear two toothed gear segments whose cam rollers cooperate with the two cams.

A transmission developed in accordance with the invention has the advantage, in addition to simple construction, that even after a lengthy period of operation it still operates with very little play and therefore with little noise since the cam rollers, respectively, can be guided in "force-actuated and/or form-locked manner on the cams or complementary cams respectively and there is merely the play between the toothed segment or segments and the driven pinion. Another advantage from a transmission standpoint is that the characteristic curve of the movement can be particularly well-adapted to the special requirements. Thus it is possible, for instance, by means of the asymmetry of the two complementary cams, not only to delay the driven shaft with respect to the drive shaft but even to let it travel backwards for a short time in order to be able to effect with sufficient reliability given coupling operations on the driven means for the shedding mechanism which are supported on the driven shaft.

Further details, features and advantages of the object of the invention will become evident from the following description of the accompanying drawings in which a shedding mechanism for a loom and a preferred transmission are shown diagrammatically or in elevation and in section.

Figure 1:
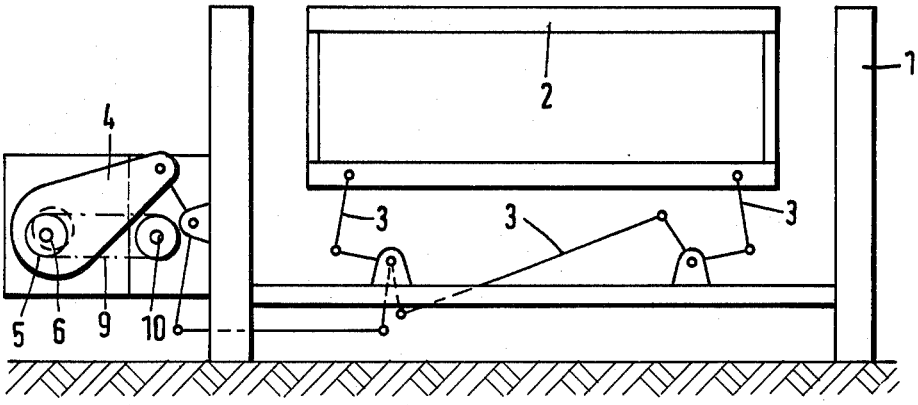
FIG. 1 shows diagrammatically a loom having a dobby as shedding mechanism.
Figure 2:
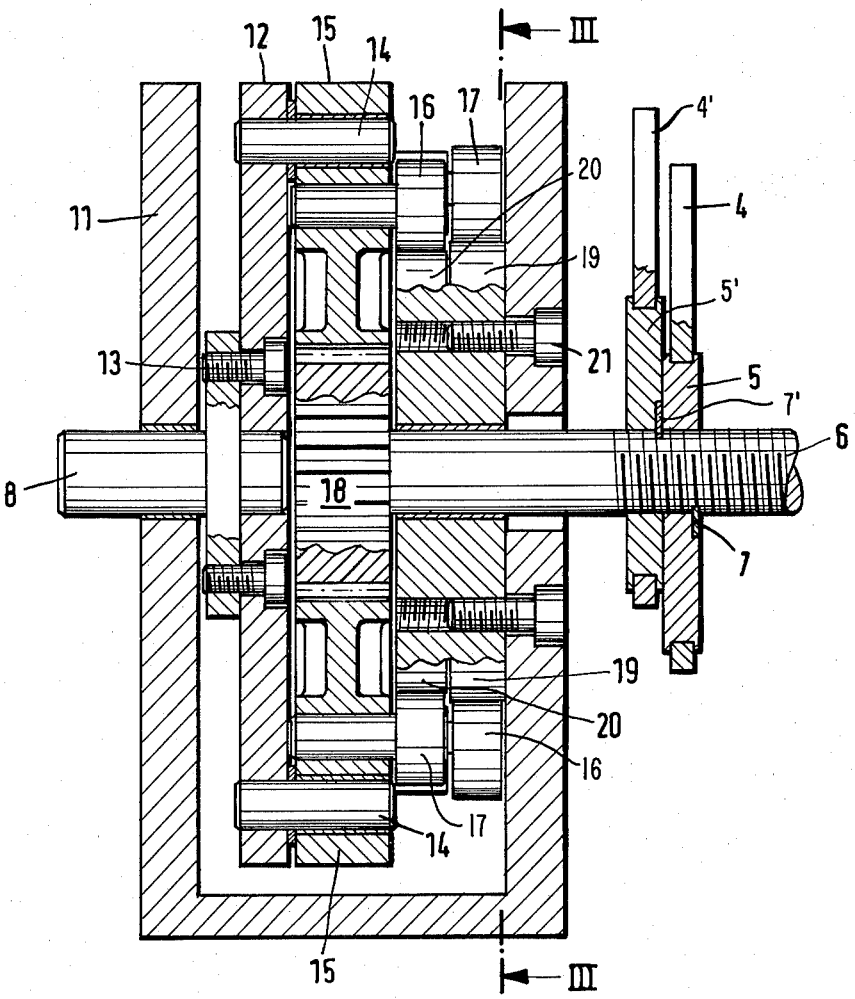
FIG. 2 shows the transmission in a section along the line II—II of FIG. 3.
Figure 3:
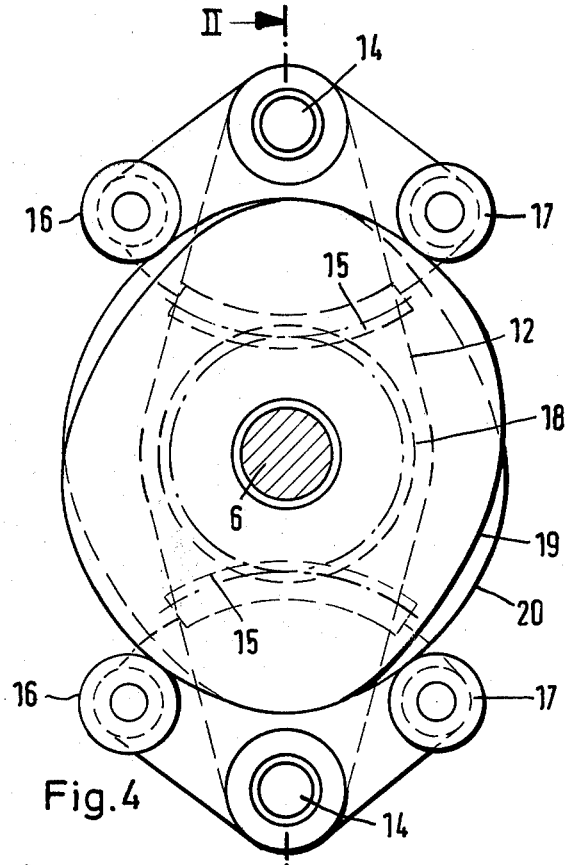
FIG. 3 shows the same transmission along the line III—III in FIG. 2, shown in elevation.

On the frame 1 of a loom, a dobby 2 is supported for raising and lowering by means of movement members 3. The actuation of the movement members 3 of a dobby 2 is effected via a crank arm 4 which is supported via an eccentric disk 5 on a driven shaft 6. The crank arms 4 which are arranged via their eccentric disks 5 alongside each other on the driven shaft 6 and which serve for a given number of dobbies 2 are moved in the manner that wedges 7 which are arranged in radially displaceable manner on the eccentric disks 5 are connected to or disconnected from the driven shaft 6 in accordance with the result of the sensing of a pattern card (not shown).

The transmission developed in accordance with the invention is arranged between the driven shaft 6 and a drive shaft 8 which is driven, for instance, via a chain drive 9 from the loom drive 10.

The driven shaft 6 and the drive shaft 8 are aligned with each other and arranged in a transmission housing 11. On the end of the drive shaft 8 a double-armed rotor 12 is fastened, fixed for rotation, by means of screw bolts 13. On the free ends of the rotor 12, two gear segments 15 are swingably supported by means of pins (eccentric shafts) 14. The gear segments 15 are of angular formation as seen in plan view and carry cam rollers 16 and 17 which are arranged alongside of each other in different planes.

Each gear segment 15 at its arcuate inner toothed periphery is in engagement with a driven pinion 18 mounted fixed for rotation on the end of the driven shaft 6, while the cam rollers 16 and 17 rollably engage against asymmetrically formed cams 19 and 20 which are fastened, fixed in position by screw bolts 21 to the transmission housing 11.

Figure 4:
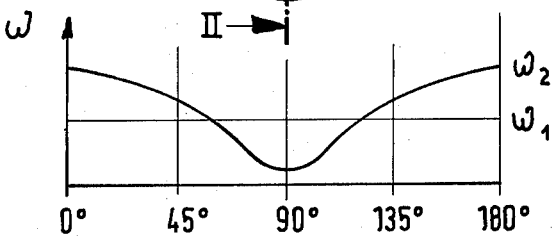
FIGS. 4 and 5 are two different diagrams of the angular speeds of the drive and driven shafts during a revolution.
Figure 5:
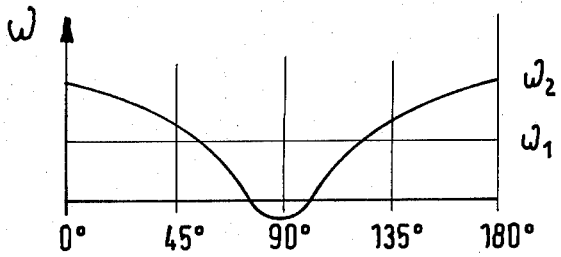

By the asymmetry of the two cams 19 and 20, upon each revolution a relative movement is produced between the driven shaft 6 and the drive shaft 8, the characteristic movement curve of which is shown in the diagrams of FIGS. 4 and 5. Thus, for instance, in accordance with the diagram of FIG. 4, with uniform angular velocity $w_1$ of the drive shaft 8, the angular velocity $w_2$ of the driven shaft 6 is decelerated upon rotation from 0° to 90° and then accelerated again from 90° to 180°. In accordance with the diagram of FIG. 5, it is even possible to make the angular velocity $w_2$ of the driven shaft 6 negative as compared with the angular velocity $w_1$ of the drive shaft 8 at 90°, in other words at a given point, for instance in the coupling region of the wedge 7 (which occurs at a predetermined angular position of the driven shaft 6), to allow the driven shaft 6 first of all to pass the coupling place in the direction of movement, then bring it back again and again allow it to pass same so that the wedge 7 has sufficient opportunity to be dependably engaged or disengaged.

I claim:

1. In a transmission for a shedding mechanism (dobby) of a loom for the production of a nonuniform drive from a uniform drive comprising a drive shaft and a driven shaft aligned therewith, said shafts being supported in a transmission housing, the improvement comprising a rotor arranged fixed for rotation on said drive shaft, at least one gear segment, an eccentric shaft swingably supports said gear segment on said rotor, each of said at least one gear segment has two cam rollers arranged in different planes, a driven pinion arranged fixed for rotation on said driven shaft engages said gear segment, two cams fastened in said different planes respectively to the transmission housing, said cam rollers cooperate with said cams in form-locked manner, said cams are asymmetrically formed such that an adjustable relative movement per revolution between the drive shaft and the driven shaft is produced dependent on the form of said two cams.

2. The transmission according to claim 1, wherein said two cams are shaped such that said driven shaft passes, in a main direction of rotation, a predetermined angular position, rotates in reverse back to said position and then continues in said main direction of rotation per revolution.

3. The transmission according to claim 1, wherein said two cams are releasably fastened on the transmission housing, said relative movement per revolution between the drive shaft and the driven shaft being adjustable by replacing said two cams with a different set of the two cams having a different form to provide a different relative movement per revolution between the drive shaft and the driven shaft.

4. The transmission according to claim 1, wherein, said shedding mechanism includes movement members of at least one dobby, a crank arm is operatively mechanically connected to said movement members, an eccentric disc is mounted on said driven shaft, said crank arm is mounted on said eccentric disc, and a wedge is radially displaceably mounted on said eccentric disc and said driven shaft for connection and disconnection, respectively, from the latter.

5. The transmission according to claim 4, further comprising a plurality of said movement members and a plurality of said dobbies associated with a plurality of said crank arm, said eccentric discs and said wedges, respectively, said eccentric discs and said wedges are arranged adjacent each other on said driven shaft.

6. The transmission according to claim 1, wherein said rotor is formed with two arms, two of said gear segments, each of said two arms carries one of said two gear segments, respectively, said cam rollers of each of said two gear segments cooperate with said two cams.

7. The transmission according to claim 6, wherein said two arms of said rotor are 180° apart.

8. The transmission according to claim 7, wherein said two cams are disposed about said driven shaft closely between said pinion, said gear segments and said transmission housing, and said rotor is disposed adjacent a side of said pinion and said gear segments opposite from that of said two cams.

9. The transmission according to claim 8, wherein said cam rollers engage peripheral surfaces of said cams, respectively.

10. The transmission according to claim 6, wherein said two gear segments and said cam rollers are disposed symmetrically about a coaxial line of both of said shafts.

* * * * *